US006357154B1

(12) United States Patent
Pfendler et al.

(10) Patent No.: US 6,357,154 B1
(45) Date of Patent: Mar. 19, 2002

(54) CO-EXTRUDED CLIP-ON LABEL HOLDER

(75) Inventors: James E. Pfendler; Paul J. Butcher, both of Erie, PA (US)

(73) Assignee: Formtech Enterprises, Inc., Stow, OH (US)

( * ) Notice: Subject to any disclaimer, the term of this patent is extended or adjusted under 35 U.S.C. 154(b) by 0 days.

(21) Appl. No.: 09/448,258

(22) Filed: Nov. 24, 1999

(51) Int. Cl.[7] ..... G09F 3/18

(52) U.S. Cl. ..... 40/661.03; 40/658; 40/661; 40/666

(58) Field of Search ..... 40/658, 661, 661.03, 40/666, 642.01

(56) References Cited

U.S. PATENT DOCUMENTS 4,557,064 A * 12/1985 Thompson ..... 40/10 R
D381,695 S * 7/1997 Lewis ..... D20/40
5,899,011 A * 5/1999 Brinkman ..... 40/661.03
6,026,603 A * 2/2000 Kump et al. ..... 40/661.03
6,105,295 A * 8/2000 Brinkman ..... 40/661.03

* cited by examiner

*Primary Examiner*—Chuck Y. Mah
*Assistant Examiner*—Enoch E Peavey
(74) *Attorney, Agent, or Firm*—Buckingham, Doolittle & Burroughs, LLP; Louis F. Wagner

(57) ABSTRACT

A label holder for general merchandising has a pair of resilient fingers which permit it to be clipped onto a lower flange of a shelf. The holder is bottom-loading and includes an opaque back portion of durable plastic and a transparent window portion, the two extruded portions uniting along an upper edge. The window portion is generally coextensive with the back portion and preferably extends past the lower edge thereof Two sets of rigid ribs overlap in the space between the back portion and the window portion and interact to clamp an upper edge of a label retaining it in place until removal or relocation is desired.

12 Claims, 1 Drawing Sheet

CO-EXTRUDED CLIP-ON LABEL HOLDER

The present invention is directed to a ticket or label holder for attachment to merchandising shelves. More particularly, the present invention is directed to a label holder which is co-extruded, can be clipped on to the face of the shelf and which will permit the changing of one label without affecting the location or position of an adjacent label held by the same label holder.

BACKGROUND AND SUMMARY OF THE INVENTION

The merchandising industry has developed numerous ways to display product/pricing information in front of items tendered for sale. One type of label holder is top loaded. There are a number of problems with top-loaded holders. First, oversized labels, which are becoming popular with retailers, typically extend above the edge of the shelf and interfere with the removal of items. This inevitably results in labels being knocked out of their holders so that the merchandise is unlabeled/unpriced. As an alternative, retailers may use tape to adhere the oversized label to the outside of the window or use a bent down flap which is received in the window. Both of these solutions require additional expense and have their own operational draw backs.

A In addition, top-loaded holders are subject to particles (crumbs, dirt, liquids, scraps of paper) falling into the loading slot. These particles/liquids may obscure the information on the label and, at the very least, present an unsightly appearance and a housekeeping headache. Lastly, where the label does not extend above the edge of the holder, changing the label becomes difficult since the holder must be pried open wide enough for the worker to insert her/his finger to engage the label. Such prying open may result in the joint on the window becoming fatigued so that the window hands open exacerbating the problem of the top-loaded holder catching debris.

Another type of label holder is bottom loaded and utilizes a plurality of flexible fingers extending from both sides to grip the label. While this bottom-loading design does not have the problem of collecting debris, it has several problems of its own. First, when a label must be changed in a continuous strip which holds several labels, pulling the label out typically reverses the direction of bias on the flexible fingers which will result in adjacent labels becoming skewed or dropped as a result of this particular label being changed. In addition, some stores have experienced breakage of these holders resulting in general dissatisfaction with this holder.

Regardless of whether the label holder is top loading or bottom loading, existing designs suffer from another deficiency related to their means of mounting to the shelf A number of the designs clip inside the upper and lower flanges on the front lip of the shelf This requires the holder to be configured to fit a particular shelf size. Conventional shelving has three different sized front lips which require the retailer to stock three different size holders.

The label holder of the present invention overcomes the problems associated with these prior art devices. The present invention comprises a co-extruded, clip-on label holder which includes a first generally planar back portion made of opaque plastic and having means for attachment to a shelf, a window portion made of transparent plastic and attached along one edge of the back portion and extending generally downwardly forming a bottom-loaded label holder. Since the label holder clips onto the lower flange of the front lip of the shelf, the holder can be used with any sized shelf and variations in distance between the upper and lower flanges resulting from bending and the like, are of no consequence.

A first rigid rib means extends from the back portion toward the window portion and a second rigid rib means extends from the window portion toward the back portion, the first and second rigid rib means cooperating to engage an upper edge portion of a label and secure it in position. First and second rigid rib means secure a label in position and change out of adjacent labels do not affect its location. Since the holder of the present invention is bottom loading, any crumbs or liquid will simply run off the window and will not interfere with the display of information on the label. The windows do not have to pried open enough to afford finger access as is the case with some top-loaded designs, which reduces the fatiguing of the joint between the window and the back portion. Finally, oversized labels can be displayed without the added expense of tape or flaps and without obscuring access to the shelved items.

First and second rigid rib means preferably comprise triangular shaped ribs extending the full length of the holder and extend inwardly toward the opposing window and back portion more than one half the distance therebetween. First rib means preferably includes two parallel rigid ribs while the second rib means comprises one rib which extends between the space formed by the two ribs of the first rib means. The triangular ribs are generally right triangles with a surface extending generally orthogonally to the insertion axis of the label holder, said orthogonal surface resisting removal of the label from the holder. The back portion includes a pair of resilient fingers which are designed to encircle the lower flange of a merchandise shelf The outer finger will engage behind the flange of the shelf while the inner finger is doubled-back to form a surface which will engage the front of the shelf and allow the resilient finger to be sprung outwardly during installation. The material of choice for the holder of the present invention is rigid polyvinyl chloride (RPVC) although other plastics may be used without departing from the scope of the invention.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENTS(s)

Figure 2:
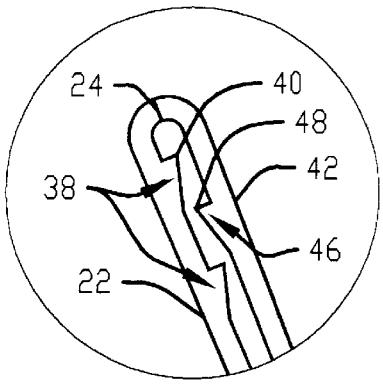
FIG. 2 is a detail of the encircled portion of FIG. 1 embodiment showing the gripping ribs; and, FIG. 3 is an end view of the holder shown mounted on the front lip of a merchandise shelf
Figure 1:
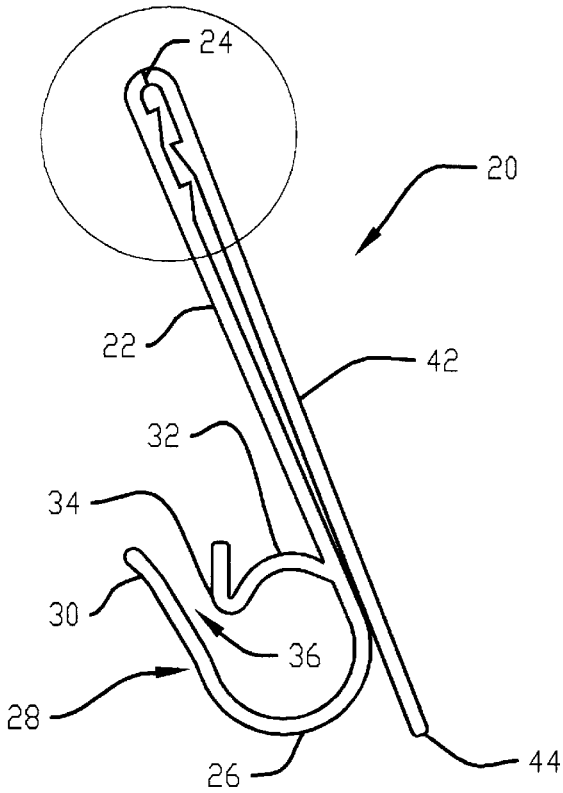
FIG. 1 is an end view of a first embodiment of the label holder of the present invention.
Figure 3:
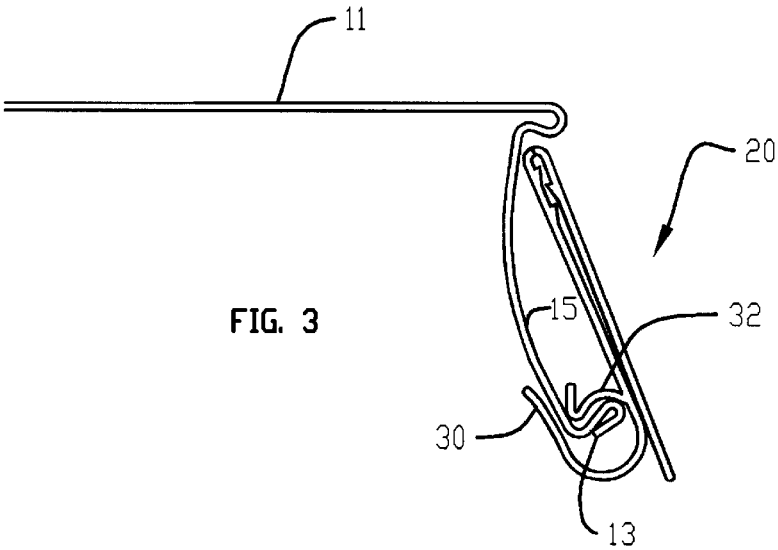

A first embodiment of the co-extruded, clip-on label holder of the present invention is shown in FIG. 1 generally at 20. Holder 20 comprises a back portion 22 extruded from a durable, opaque plastic such as RPVC. Back portion 22 is generally planar and is attached to a window portion 42 along a first edge 24. Window 42 is generally coextensive with back portion 22 and preferably has a lower edge 44 which extends a short distance beyond bottom edge 26 of back portion 22. Means 28 for attaching holder 20 to a shelf 11 (FIG. 3) are integral with second edge 26 of back portion 22. Means 28 clips onto lower flange 13 of the front shelf lip 15 comprises resilient outer finger 30 which will be received behind shelf flange 13 and resilient inner finger 32 received in front of flange 13. Inner finger 32 is doubled-back on itself to form a shelf-engaging surface 34 which permits opening 36 between outer finger 30 and inner finger 32 to be sprung open during installation (and removal) as holder 20 is snapped or clipped onto shelf flange 13. Obviously, resilient outer finger 30 can also be flexed outwardly to enlarge opening 36 to facilitate mounting and removal of holder 20 onto shelf flange 13.

Back portion 22 is equipped with rigid rib means 38 while window portion 42 is equipped with rigid rib means 46. Rib means 38 comprises at least two triangularly shaped ribs 40 extending more than half way from back portion 22 toward window portion 42. Rib means 46 comprises at least one rib 48 extending into the space between ribs 40 and, preferably, positioned half way between those two ribs, extending more than half way from window portion 42 toward back portion 22. Overlapping ribs 40 and 48 engage the upper edge of a label and retain it in position until removal is desired. Even should the lower edge 44 of window 42 be sprung outwardly to facilitate insertion or removal of an adjacent label, ribs 40 and 48 will still overlap and retain the label until removal of this particular label is performed by grasping its lower extremity and pulling upper edge out of engagement with ribs 40 and 48.

As an extruded product, holder 20 can be made in whatever length desired; it may be cut into lengths of 8', 10', or 12' for shipping or precut to the lengths desired by the merchandiser, from 2" up to the manufactured length. The merchandiser may find it convenient to place the full length of holder 20 along each of its shelves to permit labels to be located anywhere along the shelf 11.

The co-extruded, clip-on shelf holder 20 of the present invention is easily attached to the lower flange 13 of front lip 15 of shelf 11. Rigid rib means 38 and 46 of holder 20 grip the upper edge of a ticket or label in such a manner that changing an adjacent label is not impacted. Further, the fact that holder 20 is bottom loading, means that no crumbs, drips or errors fall into the window or obscure the information presented on the label.

Various changes, alternatives and modifications will become apparent to one of ordinary skill in the art following a reading of the foregoing specification. It is intended that any such changes, alternatives and modifications as fall within the scope of the appended claims be considered part of the present invention.

What is claimed is:

1. A co-extruded, clip-on label holder comprising a) a back portion made of opaque plastic material, said back portion being generally planar and including means to attach said clip-on label holder to a display shelf, b) a window portion made of transparent plastic material attached to a first end of and opposing said back portion, said window portion extending in a downward direction to form a bottom-loaded label holder;

c) first rigid rib means extending from said back portion toward said opposing window portion;

d) second rigid rib means extending from said window portion toward said opposing back portion;

whereby said first and second rigid rib means cooperate to engage an upper edge portion of a label and retain it in a desired position until it is removed for relocation.

2. The label holder of claim 1 wherein said first and second rigid rib means overlap, each extending more than half way toward said opposing window and back portions.

3. The label holder of claim 2 wherein said first rigid rib means comprises at least two rigid ribs extending along a length of said back portion.

4. The label holder of claim 3 wherein said second rigid rib means comprises at least one rigid rib positioned to extend into a space between said at least two rigid ribs which comprise said first rib means.

5. The label holder of claim 1 wherein means to attach said clip-on label holder to a display shelf comprise a pair of resilient fingers connected to a second end of said back portion for encircling a lower flange of a shelf and attaching said label holder to the shelf.

6. The label holder of claim 5 wherein said pair of resilient fingers include an outer finger which will engage behind the shelf and an inner finger doubled back on itself to form a surface which will engage in front of the shelf.

7. The label holder of claim 1 wherein said window portion is generally coextensive with said back portion.

8. The label holder of claim 7 wherein said window portion extends slightly beyond a lower end portion of said back portion.

9. The label holder of claim 1 wherein said first and second rigid rib means each comprise triangularly shaped ribs.

10. The label holder of claim 9 wherein said first and second rigid rib means each comprise right triangularly shaped ribs with a surface orthogonal to an axis of said label holder, said orthogonal surfaces positioned to resist removal of the label from said label holder.

11. A co-extruded, clip-on label holder comprising a) a back portion made of opaque plastic material, said back portion being generally planar;

b) a window portion made of transparent plastic material attached to a first end of and opposing said back portion, said window portion extending in a downward direction;

c) a pair of resilient fingers connected to a second end of said back portion for encircling a lower flange of a shelf and attaching said label holder to the shelf;

d) first rigid rib means extending from said back portion toward said opposing window portion;

e) second rigid rib means extending from said window portion toward said opposing back portion;

whereby said first and second rigid rib means cooperate to engage an upper edge portion of a label and retain it in a desired position until it is removed for relocation.

12. A co-extruded clip-on label holder comprising a) a back portion made of opaque plastic material, said back portion being generally planar;

b) a window portion made of transparent plastic material attached to a first end of and opposing said back portion, said window portion opening in a downward direction;

c) a pair of resilient fingers connected to said back portion for encircling a lower flange of a shelf and attaching said label holder to the shelf, an outer finger which will engage behind the shelf and an inner finger doubled back on itself which will engage in front of the shelf;

d) rigid rib means extending from said back portion toward said opposing window portion and from said opposing window portion toward said back portion;

whereby said doubled-back inner finger provides a rounded surface which may be engaged by the shelf to spring said outer and inner fingers open to facilitate clipping said holder onto the lower flange of the shelf and removal therefrom.

* * * * *